US007661204B2

(12) United States Patent
Maxson

(10) Patent No.: US 7,661,204 B2
(45) Date of Patent: Feb. 16, 2010

(54) INSOLE

(76) Inventor: Floyd S. Maxson, 4548 NE 6th Ave., Oakland Park, FL (US) 33334

( * ) Notice: Subject to any disclaimer, the term of this patent is extended or adjusted under 35 U.S.C. 154(b) by 639 days.

(21) Appl. No.: 11/393,613

(22) Filed: Mar. 30, 2006

(65) Prior Publication Data

US 2007/0227044 A1 Oct. 4, 2007

(51) Int. Cl.
*A43B 13/38* (2006.01)

(52) U.S. Cl. ..... 36/44; 36/3 R

(58) Field of Classification Search ..... 36/43, 36/44, 3 R, 3 B
See application file for complete search history.

(56) References Cited

U.S. PATENT DOCUMENTS

| | | | | |
|---|---|---|---|---|
| 3,882,868 | A | 5/1975 | Tundermann | |
| 4,062,131 | A | 12/1977 | Hsiung | |
| 4,185,402 | A * | 1/1980 | Digate | 36/44 |
| 4,186,499 | A | 2/1980 | Massok, Jr. et al. | |
| 4,228,549 | A | 10/1980 | Rispoli | |
| 4,279,213 | A * | 7/1981 | Urahama et al. | 116/200 |
| 4,387,516 | A * | 6/1983 | Laux | 36/43 |
| 4,517,308 | A * | 5/1985 | Ehlenz et al. | 502/401 |
| 4,864,740 | A * | 9/1989 | Oakley | 36/44 |
| 5,465,508 | A | 11/1995 | Bourdeau | |
| 5,894,682 | A * | 4/1999 | Broz | 36/31 |
| 6,044,497 | A | 4/2000 | Richardson | |
| 6,247,182 | B1 * | 6/2001 | Tasbas | 2/239 |
| 6,336,227 | B1 | 1/2002 | Liput et al. | |
| 6,481,120 | B1 * | 11/2002 | Xia et al. | 36/44 |
| 6,578,291 | B2 * | 6/2003 | Hirsch et al. | 36/132 |
| 6,766,539 | B1 | 7/2004 | Huber | |
| 6,946,196 | B2 * | 9/2005 | Foss | 428/373 |
| 7,047,671 | B2 * | 5/2006 | Steed et al. | 36/44 |
| 7,353,770 | B2 * | 4/2008 | Sanguinetti | 116/200 |
| 2001/0049890 | A1 * | 12/2001 | Hirsch et al. | 36/132 |
| 2002/0066209 | A1 * | 6/2002 | Steed et al. | 36/44 |

FOREIGN PATENT DOCUMENTS

| | | |
|---|---|---|
| WO | WO 8601084 A1 * | 2/1986 |

* cited by examiner

*Primary Examiner*—Marie Patterson
(74) *Attorney, Agent, or Firm*—Dale J. Ream

(57) ABSTRACT

An insole according to the present invention includes an upper layer defining at least one well containing a chemical indicator that gradually changes colors upon exposure to salt or sulfur. The insole includes a lower layer connected to the upper layer that includes an adhesive for stacking multiple insoles together in packaging and for holding the insole in place in a shoe. The insole includes an absorbent material for absorbing perspiration. Perspiration produces salt and bacterial and fungal degradation of keratin skin cells produces sulfur, leading to foot odor. The insole includes fungicide and deodorant for controlling this odor and the color change of the chemical in the well provides a visual indication of when a new insole (with it fungicide and deodorant) needs to be replenished through replacement.

5 Claims, 4 Drawing Sheets

INSOLE

BACKGROUND OF THE INVENTION

This invention relates generally to an insole for insertion into shoes and, more particularly, to an insole having absorbent and deodorant properties as well as an indicator of when the insole needs to be replaced.

It is well known that a foul odor is produced on a person's foot when sweat mixes with natural skin bacteria or fungus. Specifically, the Eccrine sweat gland in a person's foot secretes water and traces of salt which tend to soften cells from skin and hair known as keratin cells. Bacterial and fungal degradation of keratin cells yield acidic byproducts having a foul odor.

Various products have been proposed in the art and promoted in commerce for controlling foot odor. Specifically, insoles for shoes have been proposed that reduce, eliminate, or mask foot odor. Although assumably effective for their intended purposes, the existing products and prior patent proposals do not provide a clear indicator of when the odor-fighting insole needs to be replaced, assuming that a return of foot odor is not a desirable indicator.

Therefore, it would be desirable to have an insole for insertion into a shoe that is absorbent and includes anti-bacterial, anti-fungal, and deodorant functions. Further, it would be desirable to have an insole that provides a visual indication when it needs to be replaced. In addition, it would be desirable to have a plurality of insoles that may be packaged together with each insole having a light adhesive for stacking purposes.

SUMMARY OF THE INVENTION

Accordingly, an insole according to the present invention includes an upper layer having an upper surface that defines at least one well. Preferably, the well includes a chemical indictor that slowly changes color to measure and indicate exposure to a predetermined substance (such as salt or sulfur). As the chemical changes color, it indicates that salt and sulfur are building up due to bacterial and fungal degradation of keratin. A sufficient color change prompts a user to replace the insole with a new one. The insole also includes a lower layer presenting a lower surface having an adhesive for attachment to other lower layers (for stacking purposes) or to attach to an interior surface of a shoe.

Therefore, a general object of the present invention is to provide an insole for fighting the problem of foot odor.

Another object of this invention is to provide an insole, as aforesaid, having a chemical indicator for visually indicating when the insole needs to be replaced, i.e. when it is no longer able to control the problem of foot odor as desired.

Still another object of this invention is to provide an insole, as aforesaid, which includes an absorbent material for absorbing perspiration.

Yet another object of this invention is to provide an insole, as aforesaid, in which the absorbent material may be impregnated with a fungicide and deodorant.

A further object of this invention is to provide an insole, as aforesaid, in which an upper layer of the insole defines at least one well that includes the chemical for visually indicating when the insole needs to be replaced.

A still further object of this invention is to provide an insole, as aforesaid, in which a lower layer of the insole includes an adhesive for maintaining the insole in position when inserted in a shoe or for enabling the stacking of multiple insoles in packaging.

Other objects and advantages of the present invention will become apparent from the following description taken in connection with the accompanying drawings, wherein is set forth by way of illustration and example, an embodiment of this invention.

DESCRIPTION OF THE PREFERRED EMBODIMENT

Figure 1A:
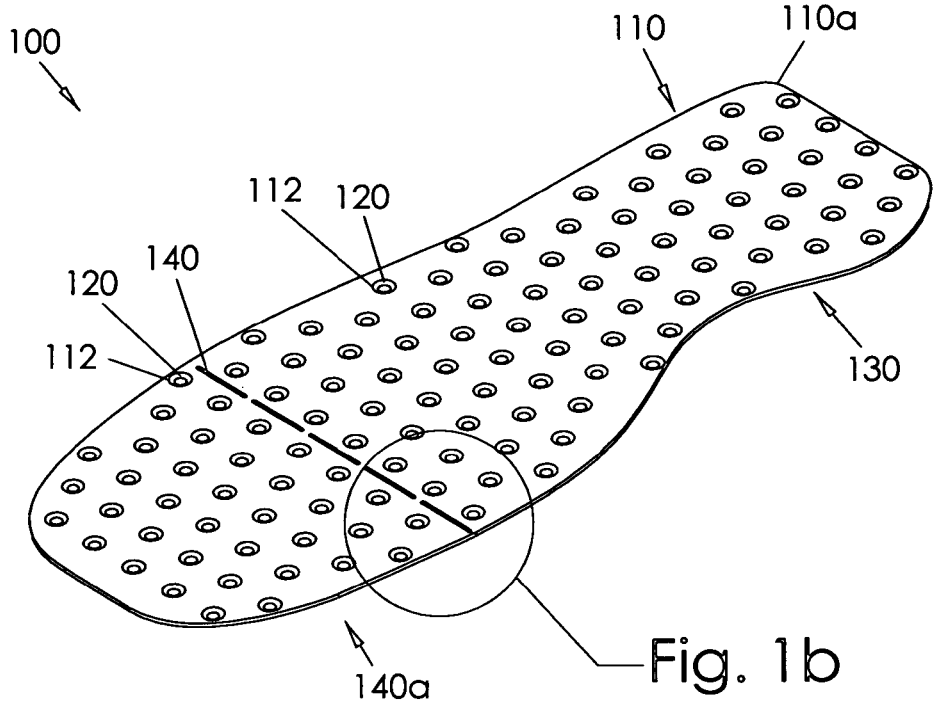
FIG. 1*a* is a perspective view of an insole according to a preferred embodiment of the present invention.
Figure 1B:
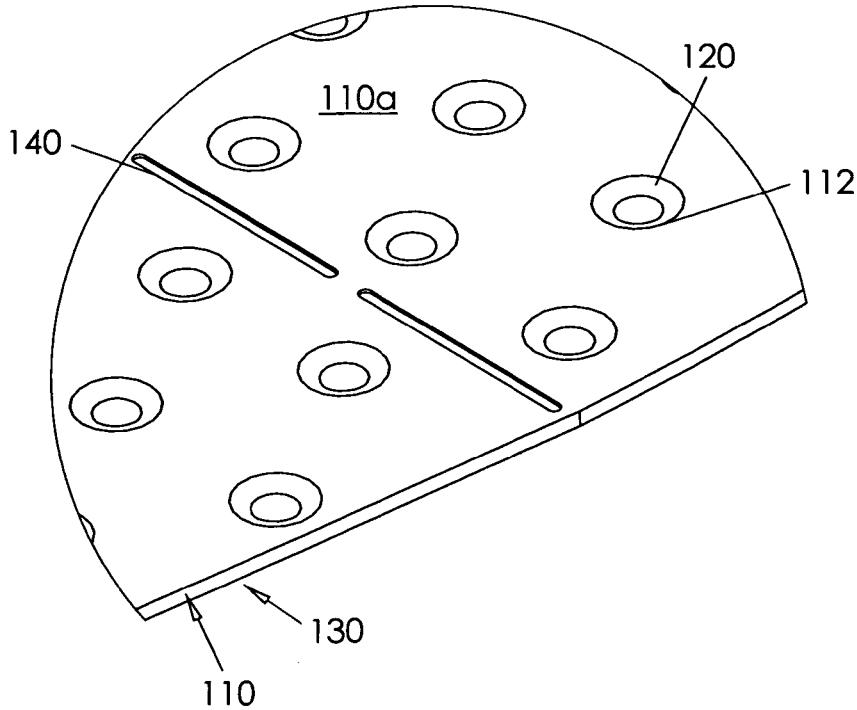
FIG. 1*b* is an isolated view on an enlarged scale of a portion of the insole as in FIG. 1*a;*
Figure 2A:
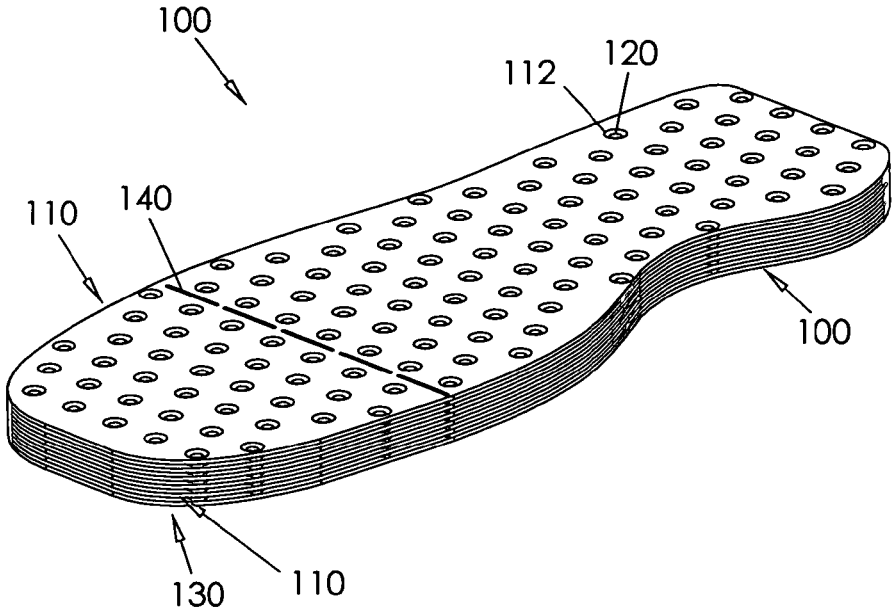
FIG. 2*a* is a perspective view of a plurality of insoles in a stacked configuration according to the preferred embodiment of the present invention.
Figure 2B:
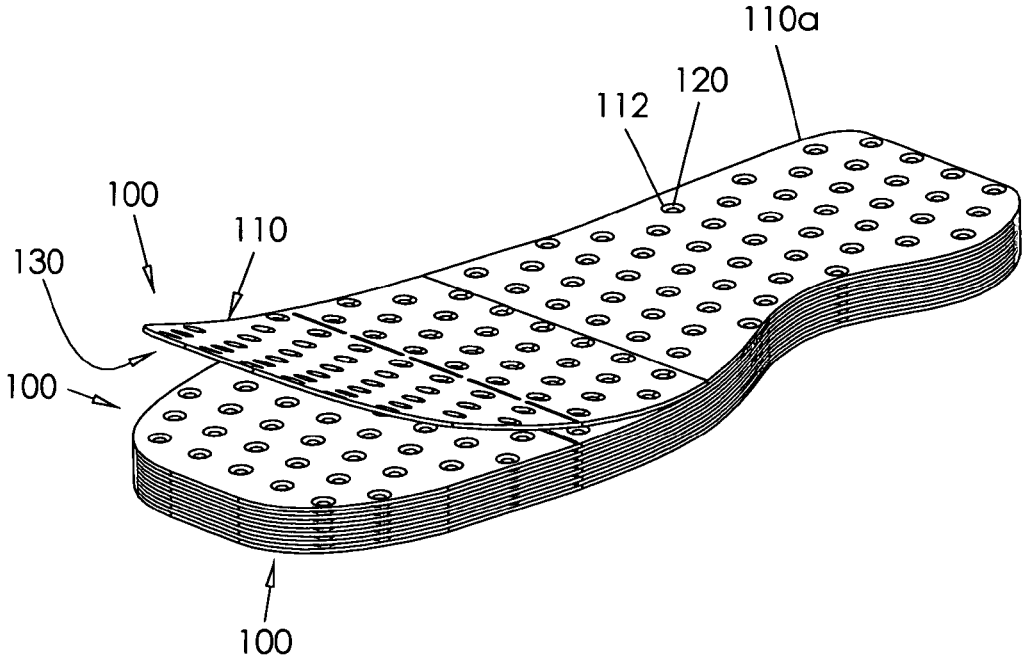
FIG. 2*b* is another perspective view of the insoles as in FIG. 2*a* with an uppermost insole in a partially removed configuration.

An insole 100 according to the present invention will now be described in detail with reference to FIGS. 1*a* through 4*b* of the accompanying drawings. More particularly, an insole 100 according to the current invention for placement in a shoe includes an upper layer 110 and an indicator 120.

The upper layer 110 presents a top surface 110*a* and defines at least one well 112 (detailed in FIG. 1*b* and FIG. 4*b*) extending downwardly from the top surface 110*a*. The upper layer 110 preferably includes an absorbent material for absorbing perspiration (e.g., cotton), a fungicide for controlling fungus, and a deodorant for controlling odor. The absorbent material may be impregnated with the fungicide and the deodorant, or the fungicide and the deodorant may otherwise be included or applied.

The indicator 120 may be positioned in the one or more well 112 to indicate when the insole 100 should be replaced. The indicator 120 may be a chemical that changes color with exposure to salt, a chemical that changes color with exposure to an acidic substance, or a chemical that otherwise notifies a user that the insole 100 should be replaced. The presence of salt and acid indicates that the insole 100 should be replaced because salt (from perspiration) and sulfur (from the bacterial and fungal degradation of keratin) builds up as the insole 100 is used. The indicator 120 preferably slowly changes color to measure an amount of exposure to a predetermined substance (e.g., salt or sulfur).

A lower layer 130 (also referred to as "second material 130" and best shown in FIG. 4*b*) may be lowerly adjacent the upper layer 110. Lower layer 130 preferably presents a lower surface having an adhesive for removably attaching the lower layer 130 to another insole 100 for shipping and packaging (FIGS. 2*a* through 3*b*). The adhesive may also function to attach the lower layer 130 to the shoe, and the lower layer 130 may include a gripping material (e.g., flexible rubber) for gripping the shoe.

Figure 3A:
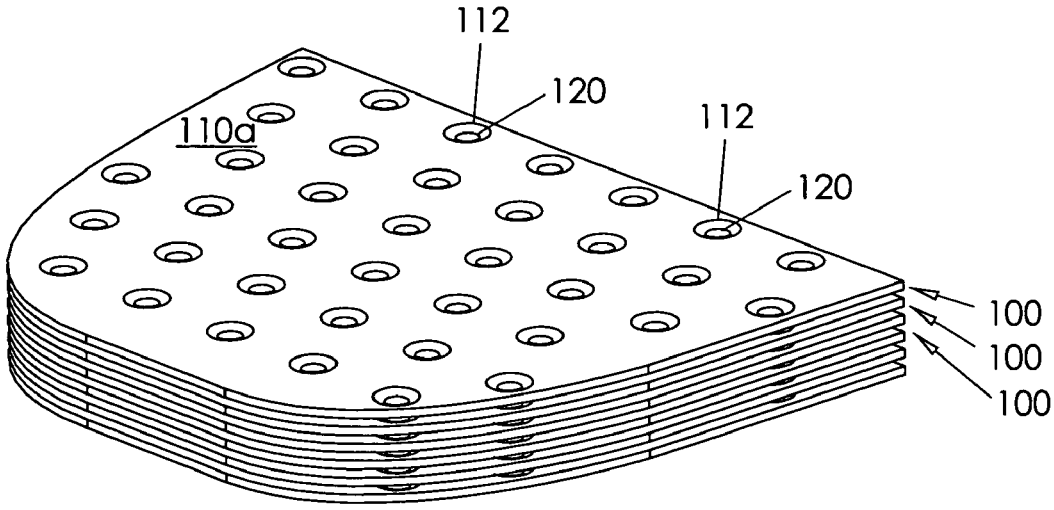
FIG. 3*a* is a perspective view of a plurality of stacked insoles according to an alternative embodiment of the present invention.
Figure 3B:
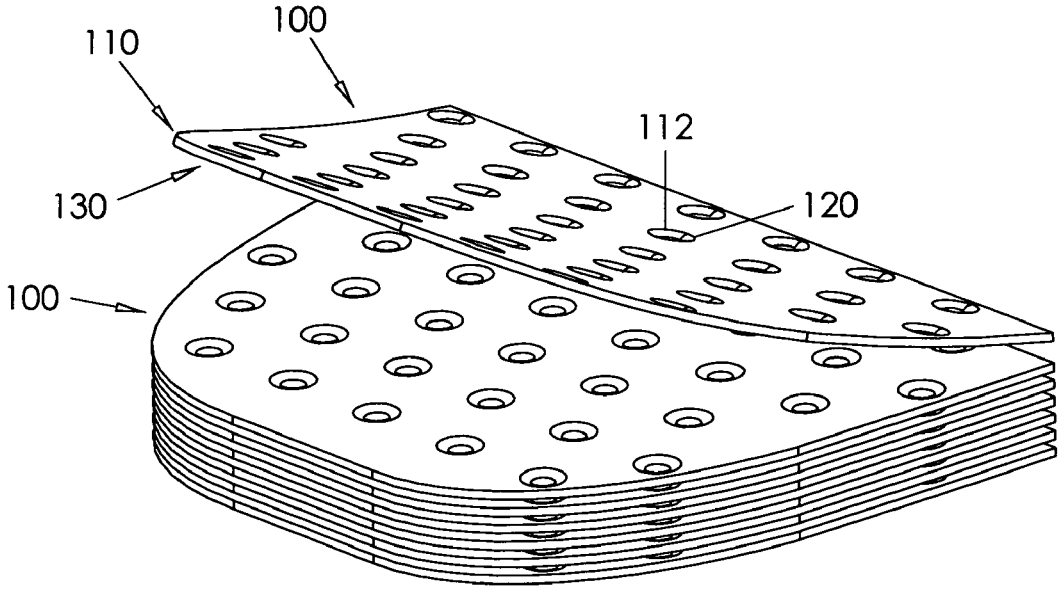
FIG. 3*b* is another perspective view of the insoles as in FIG. 3*a* with an uppermost insole in a partially removed configuration.
Figure 4A:
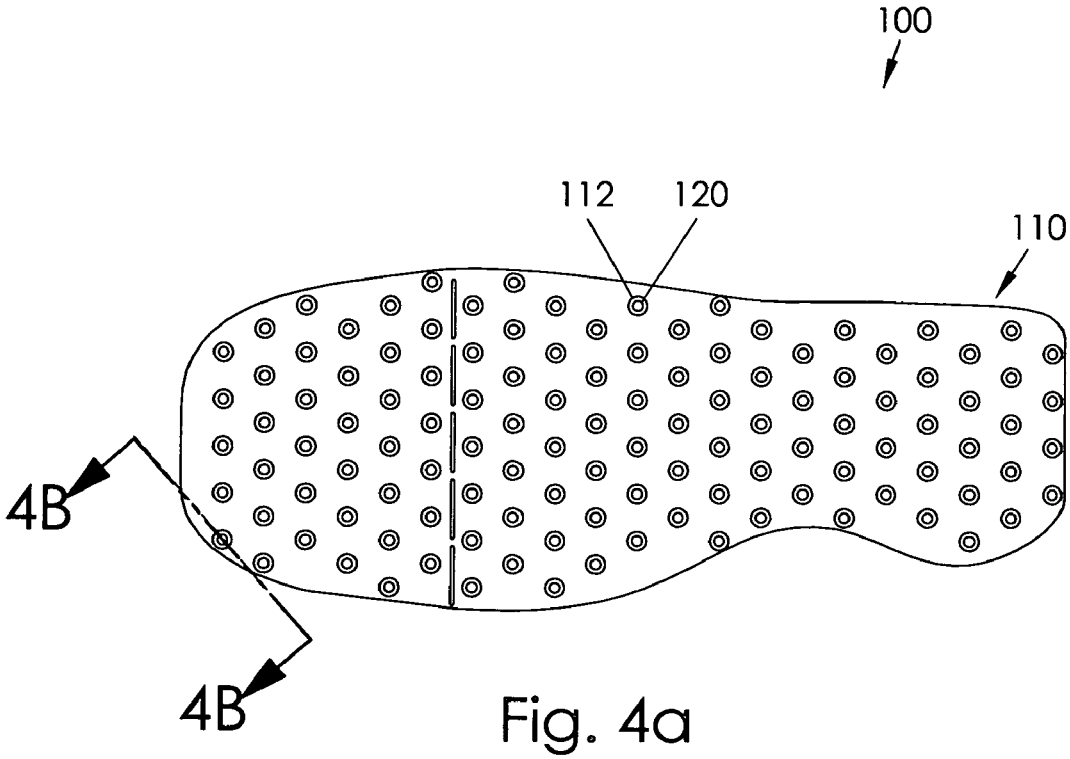
FIG. 4*a* is a top view of an insole as in FIG. 1*a;*.
Figure 4B:
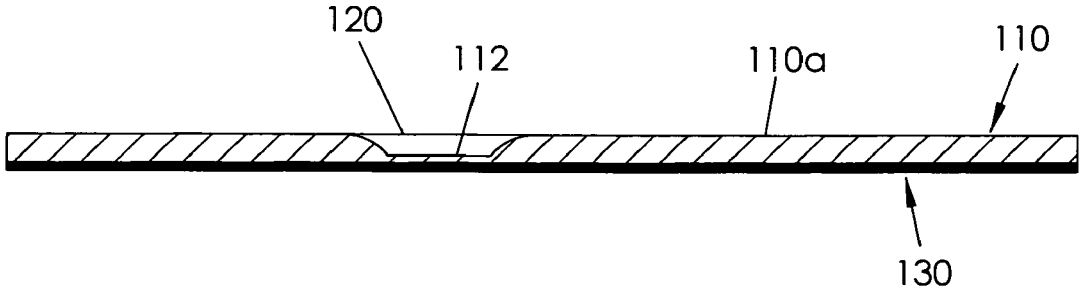
FIG. 4*b* is a sectional view taken along line 4*b*-4*b* of FIG. 4*a.*

As shown in FIGS. 1*a,* 2*a,* 2*b,* and 4*a,* the upper layer 110 and the lower layer 130 may be shaped generally complementary to a lower interior surface of a shoe. Shears may optionally be used to alter the shape of the upper layer 110 and the lower layer 130, as necessary, to be complementary to the configuration of a shoe. FIGS. 3*a* and 3*b* show that the upper and lower layers 110, 130 may alternately be shaped generally complementary to a toe section of a shoe, which may be especially useful for various styles of women's shoes. Indicia 140 (FIG. 1*a*) may also be included to mark a toe region 140*a* for selective separation by a user with shears.

In use, a user may select an insole 100 and place it in a shoe. If the insole 100 is attached to another insole 100 by adhesive on the lower layer 130 as discussed above and shown in FIGS. 2*a* through 3*b,* the insole 100 may be separated from the other insole 100 by overcoming the adhesive on the lower layer 130. If the upper and lower layers 110, 130 are not complementary to the shoe, shears may be used to alter the shape of the upper and lower layers 110, 130 as discussed above. As the user wears the shoe having the insole 100, the upper layer 110 cushions the foot and absorbs perspiration. The lower layer 130 keeps the insole 100 from moving about the shoe. The upper layer's fungicide and deodorant control fungus and odor, and the indicator 120 reacts to the predetermined substance (e.g., salt or sulfur) and changes color. Once the indicator 120 displays a predetermined color, the user is constructively advised that the insole 100 should be replaced.

It is understood that while certain forms of this invention have been illustrated and described, it is not limited thereto except insofar as such limitations are included in the following claims and allowable functional equivalents thereof.

What is claimed is as follows:

1. An insole for placement in a shoe, said insole comprising:

an upper layer presenting a top surface that includes an absorbent layer and defining a plurality of spaced apart wells extending downwardly from said top surface, each well being distinct from any other well;

an indicator in each said well for indicating when said insole should be replaced;

wherein said indicator is a chemical that changes color with exposure to a predetermined substance;

a lower layer lowerly adjacent said upper layer, said lower layer having a second material that includes an adhesive adapted to removably attach said second material to another insole for shipping and packaging; and indicia indicative of where a toe region may be selectively separated from said upper and lower layers.

2. The insole of claim 1, wherein said indicator is a chemical that changes color with exposure to salt.

3. The insole of claim 1, wherein said indicator is a chemical that changes color with exposure to an acidic substance.

4. The insole of claim 1, wherein said upper layer includes:

a configuration that is generally complementary to a configuration of a toe section of the shoe; and indicia indicative of where a toe region may be selectively separated from said upper and lower layers.

5. The insole of claim 1, wherein:

said upper layer includes a fungicide; and said upper layer includes a deodorant.

* * * * *